US006780253B2

(12) United States Patent
Moehle et al.

(10) Patent No.: US 6,780,253 B2
(45) Date of Patent: Aug. 24, 2004

(54) GRADIENT DRAGOUT SYSTEM IN A CONTINUOUS PLATING LINE

(75) Inventors: Paul R. Moehle, Attleboro, MA (US); David M. Drew, Attleboro, MA (US); Eiman A. Hegazi, Warwick, RI (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 10/189,611

(22) Filed: Jul. 3, 2002

(65) Prior Publication Data

US 2002/0179121 A1 Dec. 5, 2002

Related U.S. Application Data

(62) Division of application No. 09/671,485, filed on Sep. 27, 2000, now Pat. No. 6,443,167.
(60) Provisional application No. 60/157,781, filed on Oct. 5, 1999.

(51) Int. Cl.[7] ..... B08B 3/10; C23G 1/00
(52) U.S. Cl. ..... 134/10; 134/26; 134/34
(58) Field of Search ..... 134/10, 12, 26, 134/34, 35; 205/100, 101

(56) References Cited

U.S. PATENT DOCUMENTS

| | | | | | |
|---|---|---|---|---|---|
| 3,542,651 | A | * | 11/1970 | Yagishita | 202/169 |
| 3,616,437 | A | * | 10/1971 | Yagishita | 204/232 |
| 3,640,331 | A | * | 2/1972 | Yagishita | 159/23 |
| 3,681,212 | A | | 8/1972 | McKissick | 204/238 |
| 3,896,828 | A | | 7/1975 | Foster et al. | 134/57 R |
| 4,257,853 | A | | 3/1981 | Quinton et al. | 204/200 |
| 4,342,624 | A | * | 8/1982 | Chute et al. | 202/176 |
| 4,379,031 | A | | 4/1983 | Krotkiewicz et al. | 204/45 R |
| 4,613,412 | A | * | 9/1986 | MacDermid | 203/91 |
| 4,781,806 | A | | 11/1988 | Tenace et al. | 204/232 |
| 4,885,095 | A | * | 12/1989 | Rich | 210/636 |
| 4,905,325 | A | | 3/1990 | Colditz | 4/321 |
| 5,063,949 | A | * | 11/1991 | Yates | 134/60 |
| 5,401,379 | A | | 3/1995 | Mazzochi | 205/99 |
| 5,932,109 | A | * | 8/1999 | Griffin | 210/709 |
| 6,019,886 | A | | 2/2000 | Drew et al. | 205/775 |
| 6,113,769 | A | * | 9/2000 | Uzoh et al. | 205/101 |
| 6,187,166 | B1 | | 2/2001 | Moehle et al. | 205/138 |

FOREIGN PATENT DOCUMENTS

| | | | | |
|---|---|---|---|---|
| DE | 2359691 A | * | 6/1975 | C25D/17/00 |
| SU | 1001023 A | * | 2/1983 | G05D/11/08 |

* cited by examiner

*Primary Examiner*—Frankie L. Stinson
*Assistant Examiner*—Joseph L Perrin
(74) *Attorney, Agent, or Firm*—Yingsheng Tung; Wade James Brady, III; Frederick J. Telecky, Jr.

(57) ABSTRACT

An enhanced gradient dragout system conserves plating chemicals, including precious metals by providing a series of tanks with cascading rinse solutions having a flow rate controlled by heating the first tank to increase the evaporation rate. A portion of the concentrated solution in the heated tank is returned to the process tank. The system minimizes the requirements for clean rinse water, and the need for emptying contaminated rinse tanks with associated recovery and disposal environmental and cost issues. The low cost system is flexible and the process is adapted to the material and process requirements of the plating line.

10 Claims, 3 Drawing Sheets

GRADIENT DRAGOUT SYSTEM IN A CONTINUOUS PLATING LINE

This is a divisional application of Ser. No. 09/671,485 filed Sep. 27, 2000, now U.S. Pat. No. 6,443,167, which is a non-provisional application claiming priority of provisional application No. 60/157,781 filed Oct. 5, 1999.

FIELD OF THE INVENTION

This invention relates generally to the field of electroplating, and more particularly to an electroplating system used in the interconnection of electronic devices.

BRIEF DESCRIPTION OF PRIOR ART

A large variety of articles are made onto which high quality precious and non-precious metals are electroplated for protective coatings. Particularly well known are jewelry articles where metal coatings improve appearance. In many other applications, metal coatings are used for surface protection to prevent corrosion and/or serve as a diffusion barrier, as for example in the fabrication of electronic devices. In other applications of electrical or electronic devices, metal films are used as electrical contact surfaces. In many of these applications, metal films which have high purity, are free of defects, and have controlled thickness and hardness are required. These quality levels and the necessary manufacturing controls contribute to a significant increase in the cost of such articles.

Integrated circuit devices, having an integrated circuit chip and a lead frame which are sealed within a protective enclosure find wide use in products, among which are consumer electronics, computers, automobiles, telecommunications and military applications. A means to electrically interconnect an integrated circuit chip to circuitry external to the device frequently takes the form of a lead frame. The lead frame is formed from a highly electrically conductive material, such as copper or copper alloys, which are stamped or etched into a plurality of leads and a central area in which the integrated circuit chip is attached. The chip is electrically connected to the leads, usually by wire bonding and the device is encapsulated to provide mechanical and environmental protection.

The lead frames are coated partially or completely with thin films of metals compatible with bonding techniques such as wire bonds or solder, and which are deposited by electroplating. The surface finish of the lead frame plays and important role in the ability to attain a reproducible manufacturing process for connecting the chip. In turn, the required surface finish contributes to lead frames being the most costly piece part used in the assembly of plastic encapsulated integrated circuits.

In plating applications where it is feasible, there are cost advantages to plating the lead frames as a continuous part, as opposed to individual pieces. For relatively thin articles, use of a reel to reel handling mechanism allows continuous plating of long pieces with a minimum number of interventions and consequently fewer opportunities for contamination of the plating baths. In particular, this technique has been applied to the manufacture of thin metal coatings, such as nickel, palladium and silver on lead frames for interconnecting integrated circuits.

While automation techniques, such as continuous reel to reel plating of lead frames do help to reduce costs, expenses associated with plating also involves productivity of the plating lines, cost and maintenance of equipment, cost of plating chemicals and high purity water, and of increasing concern, the cost of recovery or waste treatment associated with plating chemicals.

One very important aspect of the continuous plating line is chemicals dragged from the primary plating baths; included are avoidance of cross contamination of baths, loss material, in particular precious metals, and recovery and disposal impacts both on cost and on the environment, and Methods to efficiently process the chemicals and costly metals dragged out from primary plating process baths is of ongoing interest to the industry.

SUMMARY OF THE INVENTION

In accordance with the present invention, there is provided an efficient system and method for minimizing the loss of chemicals dragged out of the processing baths during the plating, including precious metals. The integrated system further drastically reduces the rinse water requirements, significantly minimizes waste treatments, and for reduces plating line maintenance time.

It is an object of the invention to provide an enhanced gradient dragout system which conserves plating and other chemical process solutions by heating the first dragout station, concentrating and maintaining a constant concentration of dragout chemicals in the first station, and returning the solution to the process bath, thereby virtually eliminating the loss of plating chemicals due to being dragged out. This is of particular importance to precious metals or toxic materials requiring recovery, in addition to disposal.

Another object of the invention is to provide an integrated dragout system and process which minimizes deionized water consumption by adding clean water only at the final station, and using a constant level system driven by the evaporation in the first dragout station to maintain solution levels in each of the dragout rinse stations.

Yet another object is to provide a system and process which reduces the need for waste treatment by maintaining the final stations at a very low level of contamination, thereby eliminating the need to empty and treat the solution. Further, the dragout chemicals concentrated in the first station are reused.

Another object of the invention is to provide a system with reduced maintenance owing to the infrequent need to change dragout rinse solutions.

Still another object of the invention is to provide a more effective rinse by heating a rinse tank.

And yet another object of the invention is to provide a process having a relatively high speed and throughput.

Other objects and advantages of the present invention will become apparent from the following descriptions, taken in connection with the accompanying drawings, wherein, by way of illustration and example, an embodiment of the present invention is disclosed.

The drawings constitute a part of this specification and include exemplary embodiments to the invention, which may be embodied in various forms. It is to be understood that in some instances various aspects of the invention may be shown exaggerated or enlarged to facilitate understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for teaching one skilled in the art to employ the present invention in virtually any appropriate detailed system, structure or manner.

Figure 1:
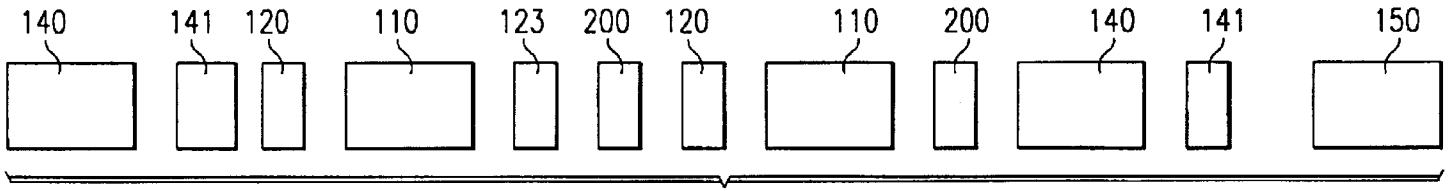
FIG. 1 (PRIOR ART)
FIG. 1 schematically depicts a portion of continuous plating line from prior art.

In order to briefly explain a continuous plating operation into which the present invention is integrated, FIG. 1 schematically provides an example of a continuous plating line. The part to be plated, such as lead frame stock material, is passed through a series of cells for cleaning, rinsing, plating and making electrical contact. It can be seem from the diagrams that a cleaning bath 140 and associated dragout and rinse station 141 are placed prior to plating baths 110 and 150. This configuration includes multiple cells having the same bath composition 110. These are followed by another clean 140 and rinse 141 station prior to a cell which contains a different plating solution 150. Contact stations 120 are positioned to maintain electrical contact between the solution and part to be electroplated.

Figure 2A:
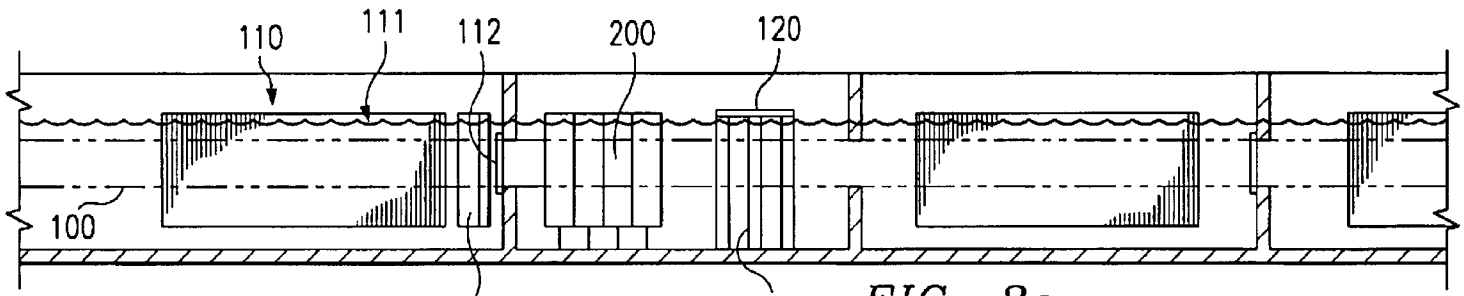
FIG. 2a (PRIOR ART)
FIG. 2*a* gives detail of two cells from a plating line of known art.
Figure 2B:
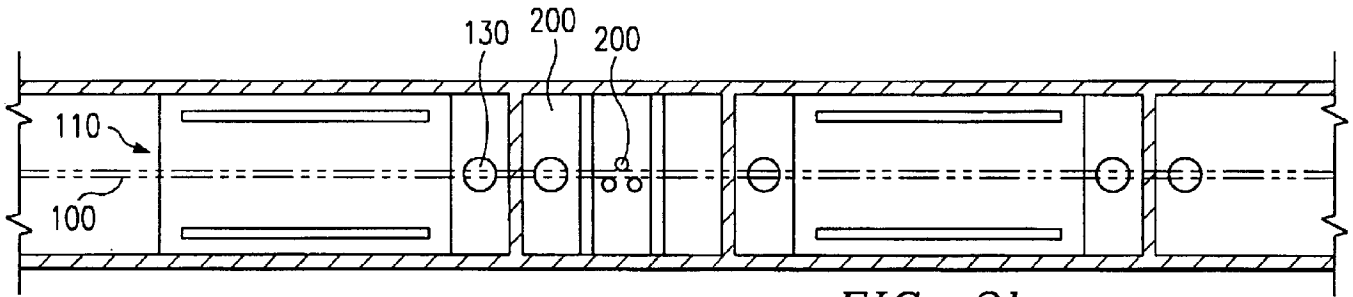
FIG. 2b (PRIOR ART)
FIG. 2*b* gives top view of two plating cells of known art.

A slightly more detailed view of a plating bath 110 and associated process stations is given in FIGS. 2*a* and 2*b*. The continuous metal strip 100 to be plated is immersed in plating solution 111 and plastic rollers 126 support the metal strip in mechanical contact against an electrical contact 120. In an attempt to minimize the amount of plating solution which is dragged from the plating cell, rubber rollers or squeegees 112 are placed at the openings of the plating cells to help contain the solution and to remove it from the article being plated. Following each process bath, an overflow container 130 and a dragout system 200 are provided to contain the chemicals dragged from the process bath. The dragout system includes a series of rinses intended to avoid any cross contamination of process chemicals and baths.

From the top view, shown in FIG. 2*b*, it can be seen that two containers and drains are provided; one 130 for overflow plating solution and the second, a dragout rinse station 200. The station includes a series of tanks to rinse and dilute chemicals and plating solutions dragged from the previous process station.

The amount of chemical dragout is a function of concentration of the bath, line speed, and product design or configuration. The loss of chemicals by dragout is significant and costly, and particularly for precious metal plating solutions.

The part emerging from the final dragout rinse station must be free of chemicals adhering to the surface which could result in cross contamination of the next process bath, and which could potentially destroy the chemical bath.

Figure 3:
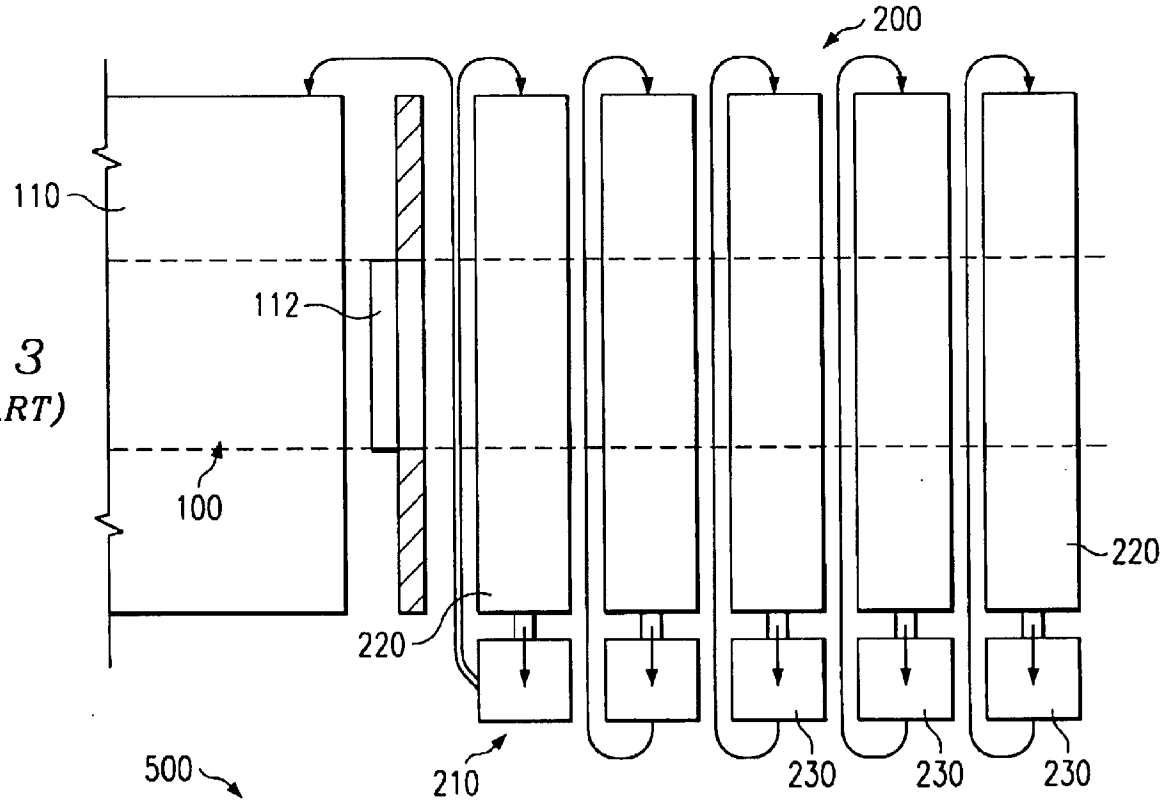
FIG. 3 (PRIOR ART)
FIG. 3 shows a schematic of a dragout system of known art.

FIG. 3 provides a detailed diagram of a typical dragout station 200 arrangement of known art, wherein a series of independent recirculating tanks 210 are arranged in line following a plating or chemical processing tank 110. The strip of lead frames 100, or other device to be plated is passed through a processing tank 110, and through a squeegee 112 or air knife to remove some of the excess chemical solution, and through the dragout rinse station.

As the process is initiated, fresh water is pumped from a sump tank 230 to an upper 220 dragout rinse tank. Each of the tanks operates as a closed loop or recirculating system, as indicated by the arrows. Solution drains from the upper process tank 220 into the sump tank 230 and is pumped back into the rinse tank. With this type of arrangement, the concentration of dragout contaminants in each tank continuously increases with use and time, and must be emptied and replaced at a specified level of contamination. As the level of contamination increases, the rinses become less effective, and more contamination is carried into the next tank in the series.

Some of the diluted dragout rinse solution from the first tank 210 is returned to the chemical processing tank 110 to avoid a total loss of the dragged out chemicals.

Each of the tanks requires a sump having a source of clean typically deionized water. The water begins to be contaminated as soon as the first parts are passed through the tanks and the concentration is continuously changing. Additional tanks may be added, but each of these will in turn continue to increase in contamination.

The plating system of FIGS. 1, 2 and 3 has been in place for a number of years, but is somewhat inefficient for chemical loss and waste recovery, and for costly maintenance of the system.

Figure 4:
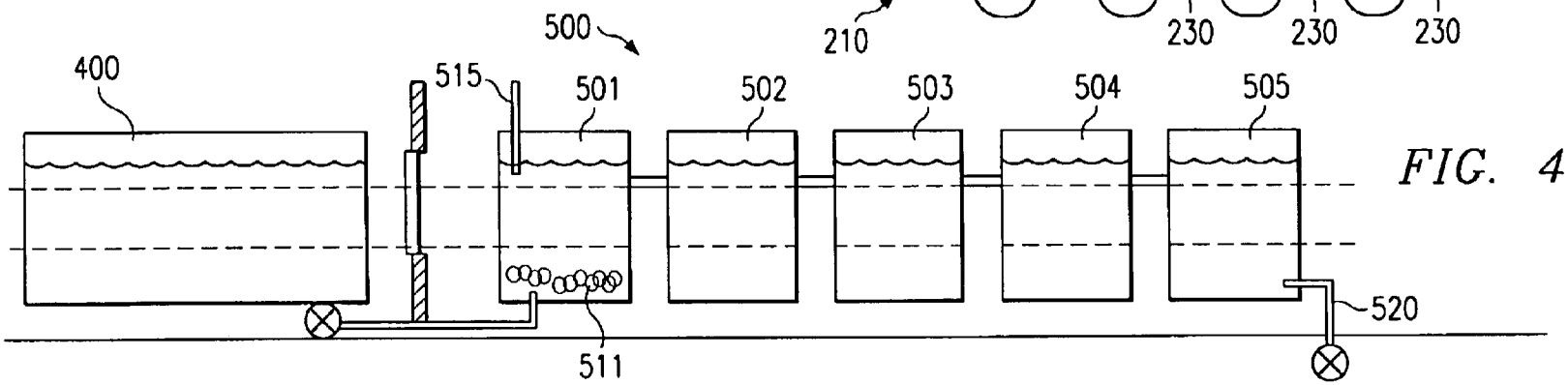
FIG. 4 provides a schematic view of the enhanced gradient dragout system of the current invention.

FIG. 4 provides a diagram of the enhanced gradient dragout system of the current invention, and is a portion of a plating line for plating lead frame stock material. Such plating lines typically include addition of thin films of plated nickel, copper, silver, and palladium or gold to the stock material.

The improved dragout system 500 integrates a series of rinse tanks 501 through 505. The dragout contamination in the later tanks is minimized and the dragged out chemicals are concentrated and maintained at a near constant level in the early tank. The series of rinse tanks having an automatic level probe 515 in the first tank in the series 501 is integrated by a cascading effect. Clean water 520 is fed into the final tank 505 in the series, and overflows into each of the tanks until the level probe in the first tank is filled to the required level, a solenoid is closed. The rate of replenishment is determined by evaporation from a heated tank 501. Typically the first rinse tank in the series is the heated tank having a mechanism for heating, such as a heating coil 511. Each tank is fed by a cascading effect from the next downstream tank in the series to maintain a constant solution level.

The critical element of the invention provides that the first, or an early dragout rinse tank 501 is heated, using a heating element 511 to increase the evaporation rate and concentrate the dragout chemicals in the tank. The higher evaporation rate of the first tank 501 drives the constant level cascading system to add solution from the next rinse tank 502, and thereby continues to keep both the solution level and the dragout chemical concentration at a near constant level. The level of the second 502 tank is kept constant by addition from tank 503. Tank 504 feeds tank 503 and is fed by tank 505. Only tank 505 requires the addition of fresh clean or deionized water. The flow rate of clean water 520 corresponds to the evaporation rate from the heated tank 501.

As a result of heating and the high evaporation rate, the first tank 501 very rapidly reaches a high level of dragout chemicals from the preceding process tank 400. However, much cleaner solution is being added from the second tank 502 to replace the evaporated water, and thereby rapidly allowing the concentration to approach a near constant level. This solution in tank 501, having a relatively high level of dragout chemicals is used to replenish the process tank 400, thereby avoiding both the chemical loss and the need for reclamation.

A further advantage of heating the rinse solution lies in increased solubility of chemicals with increased temperature, thereby providing a more effective rinse.

Because the solution in each of the tanks is being fed by a less contaminated solution from the next tank in line, the level of contamination becomes near constant after a short use time, thereby eliminating the need for emptying and cleaning the successive tanks.

Figure 5:
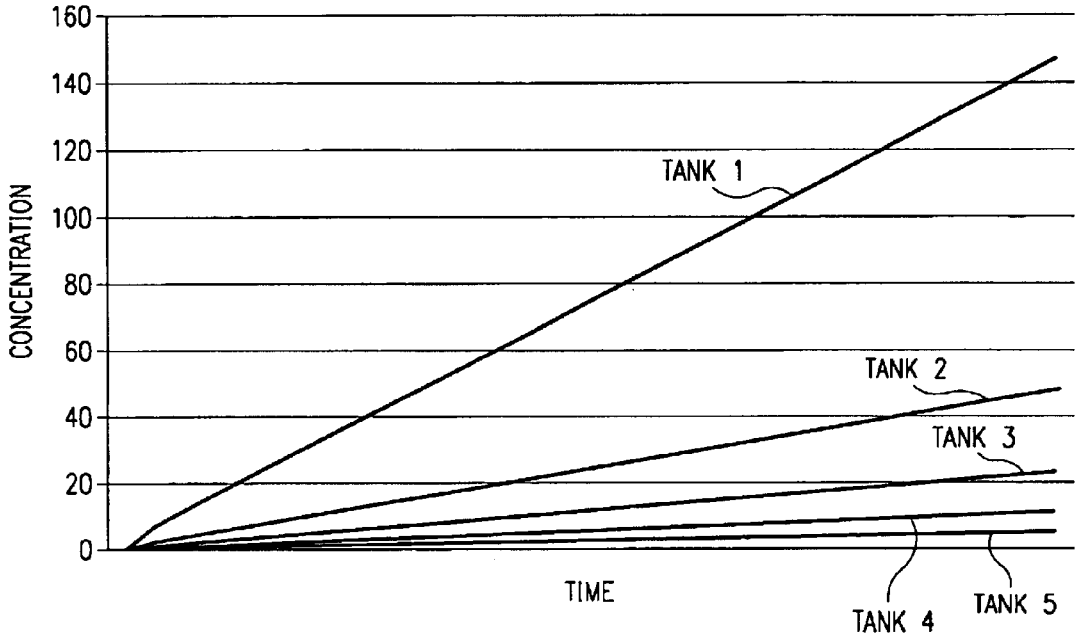
FIG. 5 (PRIOR ART)
FIG. 5 is a graph of concentration of dragout contamination versus time in a system of known art.

FIG. 5 provides a series of graphs plotting the concentration of chemicals as a function of time over time in each of five dragout tanks in a recirculating system, as illustrated in FIG. 3. From this typical data graph, it can be noted that the concentration of dragout chemical in each tank increases continuously with time. As the concentration of each rank reaches a critical level, the solution must be emptied, the toxic and/or precious components recovered and the tank refilled with clean rinse water.

Figure 6:
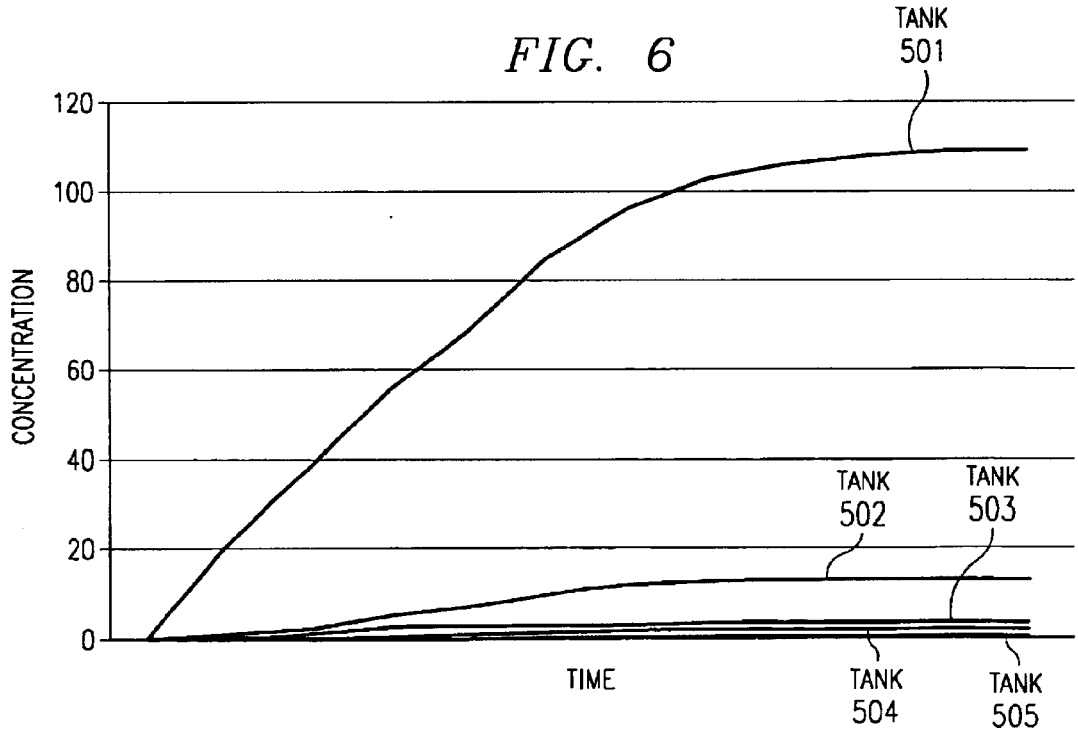
FIG. 6 is a graph of concentration of dragout contamination versus time in the enhanced gradient dragout system of the current invention.

FIG. 6 provides the contrasting graphic data of dragout chemical concentration in each tank 501 through 505 as a function of time in the enhanced gradient dragout system of the current invention. For direct comparison, each dragout system has five rinse tanks and an equal run rate. In FIG. 6, it will be noted that the dragout concentration in the first tank, increases rapidly after initial usage, but becomes nearly constant owing to the addition of near clean solution from tank 502 and to the use of solution from 501 to replenish process bath 400. It will further be noted that each of the other tanks rapidly reaches a level of dragout contamination which then plateaus and is maintained at a constant level, as a result of being fed by the next cleaner solution.

It should be clear that the precise process and configuration of the dragout rinse tanks is flexible and is dependent on the dragout chemical solution being removed, and the plating line composition and balance. For example, the preferred embodiment shown in FIG. 4 includes five (5) rinse tanks, following a palladium precious metal plating bath. Temperature of the heated rinse tank is controlled at the temperature approximately equal to or slightly higher than that of the process bath. In a preferred embodiment of a dragout system following a palladium plating bath, the composition of the plating bath allows the solution to be heated to about 120 degrees F. without seriously altering the composition. However, another type of bath is stable to about 160 degrees F., and therefore the evaporation rate is higher, more replenishing solution is added to maintain the level and the chemical balance is achieved more rapidly in the rinse tanks. Yet another chemical is less stable and heating the first rinse may prove too corrosive, so the heated tank is positioned downstream. In general, the temperature of heated rinse tanks is in the range of 100 to 175 degrees F.

Further, the enhanced gradient dragout system may be applied with each process chemical in the plating line, or only following selected process baths.

To summarize the key requirements for the enhanced gradient dragout system, the solution level of a series of rinse tanks is controlled by heating a tank early in the series, causing the evaporation rate to be increased, and the solution replenished by cleaner water from the next, and each other tank in the series. A cascading system between tanks allows clean water to be added only to the final tank in the series.

Advantages of this enhanced gradient dragout system and process include, a means for conserves plating and process chemicals dragged from process baths in a continuous plating operation by reusing the chemicals captured in a rinse bath to replenish the process bath. Dragout chemicals in subsequent rinse baths in the system are maintained at a very low level of contamination by near continuous dilution from a cleaner solution, thereby eliminating the need to empty the rinse stations and recover or treat waste for disposal of the chemicals. A further advantage includes conservation of clean or deionized water by feeding clean water into the final rinse tank only, and refilling the previous stations using the cleaner rinse solution from the next down stream tank.

Additional advantages include a more thorough rinse by heating the rinse solution in an early rinse, a simple, low cost cascading system of connected rinse tanks, and reduced maintenance owing to the infrequent need to change chemicals Finally, the system and process are flexible and may be adapted to recovery of each of the chemicals in a plating line or only selected ones.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A method for controlling a plate and rinse operation comprising the steps of:

passing a stock material through a plating bath;

passing said stock material through a series of rinse tanks, including a first rinse tank and a final rinse tank;

passing rinse from the final rinse tank into a prior rinse tank in said series, and sequentially from tank to tank, including the first rinse tank;

heating the first rinse tank to a temperature sufficient to cause a substantial rate of evaporation;

introducing fresh rinse into the final rinse tank to compensate for the evaporation loss from the first rinse tank;

monitoring the concentration of plating solution in the first rinse tank; and periodically passing solution from the first rinse tank into the plating bath.

2. The method of claim 1, wherein said first rinse tank is heated to a temperature higher than the temperature of said plating bath.

3. The method of claim 1, wherein said first rinse tank is heated to a temperature in the range of about 100 to about 175 degrees Fahrenheit.

4. The method of claim 1, wherein said plating bath contains palladium.

5. The method of claim 4, wherein said first rinse tank is heated to about 120 degrees Fahrenheit.

6. A method for controlling a plate and rinse operation comprising the steps of:

passing a stock material through a plating bath;

passing said stock material through a series of rinse tanks, including a first rinse tank and a final rinse tank;

passing rinse from the final rinse tank into a prior rinse tank in said series, and sequentially from tank to tank, including the first rinse tank;

heating at least one of the rinse tanks in said series of rinse tanks to a temperature sufficient to cause a substantial rate of evaporation;

introducing fresh rinse into the final rinse tank to compensate for the evaporation loss from said at least one rinse tank;

monitoring the concentration of plating solution in the first rinse tank; and periodically passing solution from the first rinse tank into the plating bath.

7. The method of claim 6, wherein said at least one rinse tank is heated to a temperature higher than the temperature of said plating bath.

8. The method of claim 6, wherein said at least one rinse tank is heated to a temperature in the range of about 100 to about 175 degrees Fahrenheit.

9. The method of claim 6, wherein said plating bath contains palladium.

10. The method of claim 9, wherein said at least one rinse tank is heated to about 120 degrees Fahrenheit.

* * * * *